US005109998A

United States Patent [19]

Bretschneider

[11] Patent Number: 5,109,998

[45] Date of Patent: May 5, 1992

[54] FREIGHT CONTAINER FOR AIR TRANSPORT

[75] Inventor: Gerd Bretschneider, Hilzingen, Fed. Rep. of Germany

[73] Assignee: Swiss Aluminium Ltd., Chippis, Switzerland

[21] Appl. No.: 302,236

[22] PCT Filed: May 13, 1988

[86] PCT No.: PCT/CH88/00088

§ 371 Date: Dec. 30, 1988

§ 102(e) Date: Dec. 30, 1988

[87] PCT Pub. No.: WO88/08821

PCT Pub. Date: Nov. 17, 1988

[30] Foreign Application Priority Data

May 13, 1987 [DE] Fed. Rep. of Germany ..... 3715895

[51] Int. Cl.[5] ..... B65D 85/14

[52] U.S. Cl. ..... 220/1.5; 220/668

[58] Field of Search ..... 220/1.5, 76, 84, 668

[56] References Cited

U.S. PATENT DOCUMENTS

| | | | |
|---|---|---|---|
| 1,917,764 | 7/1933 | Howie | 220/84 X |
| 3,672,529 | 6/1972 | Feddersen et al. | 220/1.5 |
| 3,904,064 | 9/1975 | Looker | 220/1.5 |
| 3,907,148 | 9/1975 | Meller et al. | 220/1.5 |
| 3,972,437 | 8/1976 | Lovich et al. | 220/1.5 |
| 4,429,730 | 2/1984 | Elston | 220/1.5 X |
| 4,493,428 | 1/1985 | Mittelmann et al. | 220/1.5 |
| 4,574,968 | 3/1986 | Mittelmann | 220/1.5 |
| 4,747,504 | 5/1988 | Wiseman et al. | 220/1.5 |
| 4,795,047 | 1/1989 | Dunwoodie | 220/84 X |
| 4,802,600 | 2/1989 | Bretschneider et al. | 220/84 X |

FOREIGN PATENT DOCUMENTS 2024164 of 1980 United Kingdom .

*Primary Examiner*—Steven M. Pollard
*Attorney, Agent, or Firm*—Bachman & LaPointe

[57] ABSTRACT

The present disclosure describes a freight container for air transportation purposes having a bottom panel and arranged thereon a support frame that features sections projecting from the bottom panel and transverse sections connecting the projecting sections, and also features planking that at least partly fills-in the frame and is fitted to flanges on the sections, the sections being interconnected at nodal points in the supporting frame, at least in part, by gusset-plates, in which, the gusset-plates are flat and are secured to flanges on the sections, the flanges being in-line with a section wall, extending it outwards beyond a hollow part of the section.

7 Claims, 2 Drawing Sheets

FREIGHT CONTAINER FOR AIR TRANSPORT

The invention relates to a freight container for air transportation purposes having a bottom panel and arranged on this a support frame that features sections projecting from the bottom panel and transverse sections connecting said projecting sections, and also features planking that at least partly fills-in the frame and is fitted to flanges on the sections, the sections being interconnected at nodal points in the supporting frame, at least in part, by gusset-plates.

A freight container of this type is disclosed in the German patent publication DE-OS 21 19 536, wherein the sidewalls comprise two parallel, vertical posts connected by a ridge section. A projecting part of the ridge section bridges an area of the said wall running externally of the bottom panel, said area being enclosed in sections and having a sloping edge running from the bottom panel up to about half of the height of the sidewall.

This shape of freight container can be accommodated in the round or oval cross-section of an aircraft fuselage and is mandatory for air freight containers.

A disadvantage of this prior art is that the differently shaped sections can be held together at the nodal points only at considerable expense and by suitable deformation of the gusset-plates.

In view of the above the object of the invention is to simplify the construction of such a freight container.

This object is achieved by way of the invention in that the gusset-plates are flat and are secured to flanges on the sections, said flanges being in-line with a wall of the section which is thus extended away from a hollow part of the section.

The design of the sections according to the invention means that deformation of the gusset plates is no longer necessary even when joining sections at angles greater or smaller than 90°. This becomes possible by the flange extensions of a wall section. Special protection is sought for this idea of extending the section wall on one or both sides by flanges for use in air-transport containers, as this design is unusual in containers; flanges have hitherto been formed in an outer surface of a sidewall and run therefore along the centerline of the cross-section. Shifting these flanges into the plane of a sidewall leads to an extraordinary improvement in the overall design of the freight container.

Further advantages, features and details of the invention may be gathered from the following description of preferred examples of embodiment and with the aid of the drawings attached herto, wherein.

Figure 1:
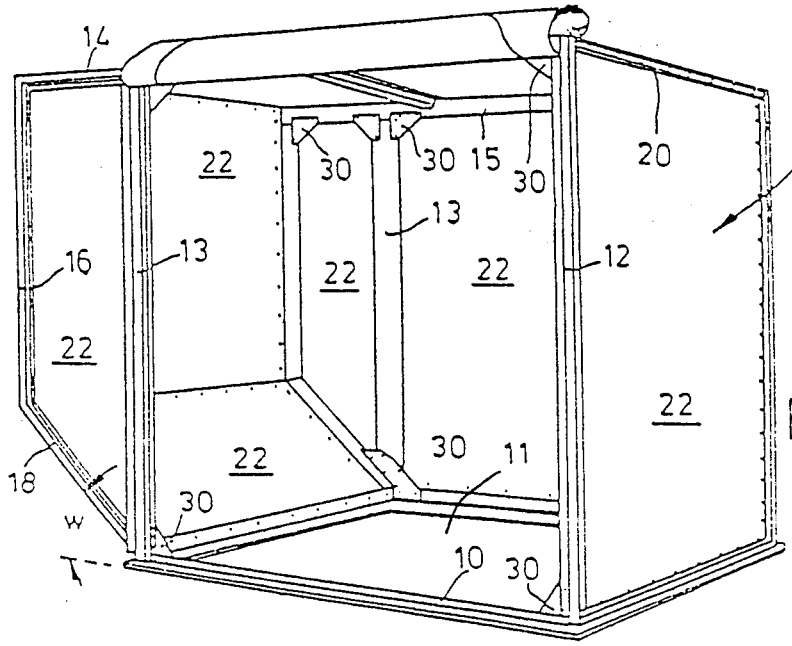
FIG. 1 is a perspective view of a freight container for air transport.
Figure 3:
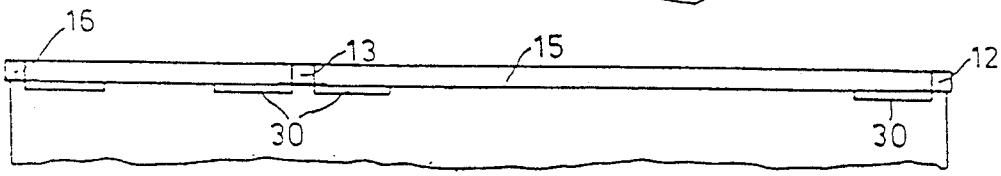
FIG. 3 is a schematic section along the line III—III in FIG. 2.
Figure 2:
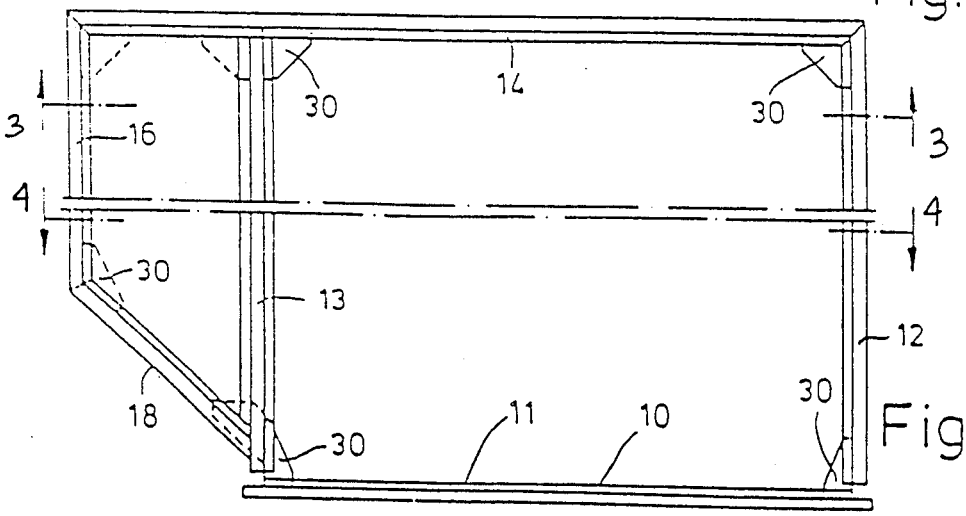
FIG. 2 is a side elevation of FIG. 1.
Figure 4:
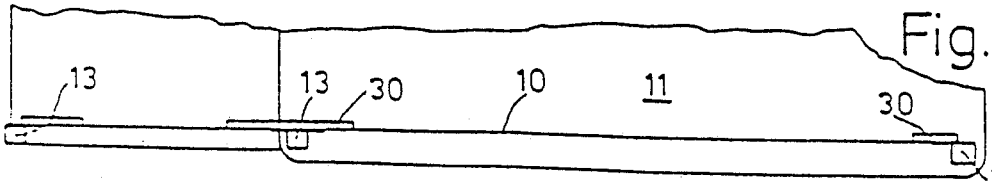
FIG. 4 is a schematic section along the line IV—IV in FIG. 2.

A freight container 9 for air transport features a bottom panel 11 with connecting strips 10 and mounted on the said panel a support frame comprising two side frames each of two vertical sections 12. 13 a ridge section 14, 15, a short frame section 16 running downwardly therefrom, and from that an inclined section 18 set at an angle w. The two sideframes 12, 13 are connected by transverse sections 20 and are filled-in with metal sheets 22.

Figure 5:
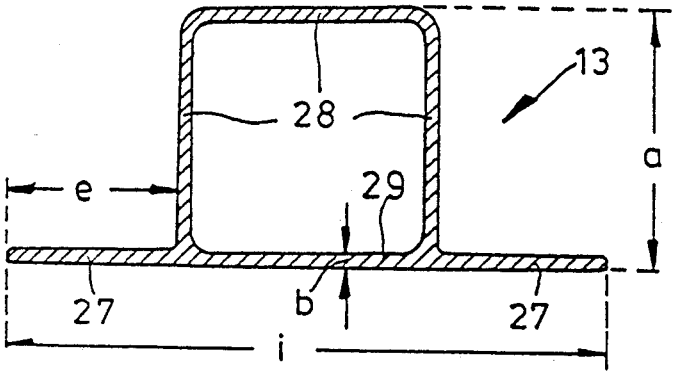
FIG. 5, 6 show enlarged parts from FIG. 3 in cross-section.
Figure 6:
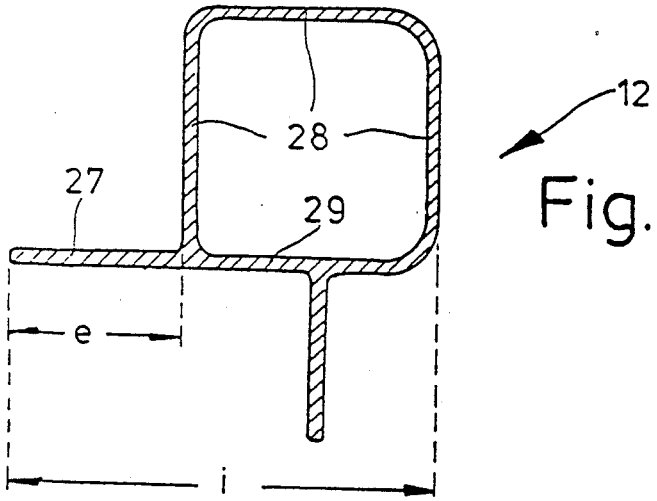
Figure 7:
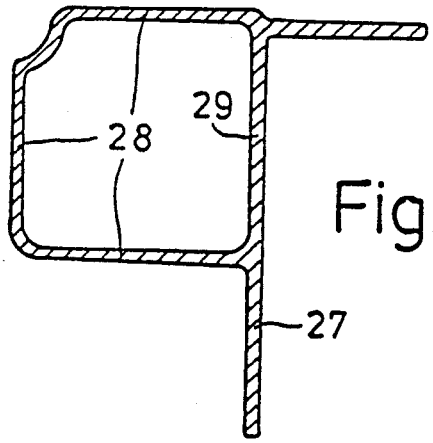
FIG. 7 is an enlarged section from FIG. 1 in cross-section.

The sections 12 to 16, 18 are joined together and to the connecting strips 10 of the bottom panel 11 by means of flat gusset-plates 30. According to FIGS. 5, 6 and 7, in order to avoid deforming the gusset-plates 30, the vertical sections 12, 13, and ridge-sections 15, are of special design; they are in the form of rectangular hollow sections having sidewalls 28, 29 of external length a of 35 mm, for example, and thickness b of 1.4 mm. The sidewall 29 in FIG. 5 is extended on both sides beyond the hollow section by flange 27 by a length e=23 mm to provide an overall length i of 81 mm. In the example shown in FIGS. 6 and 7 an extension is provided on only one side by a flange 27 to give an overall length i of wall 29 to 27, in this case=58 mm.

What is claimed is:

1. Freight container for air transportation purposes which comprises: a bottom panel; a support frame arranged on said bottom panel, said support frame including first and second pair of hollow sections projecting from the bottom panel and transverse hollow sections connecting said projecting sections, said first and second pair of hollow sections are rectangular having section walls; planking at least partly filling in said support frame and fitted to said sections; flat gusset plates interconnecting the sections of the support frame; wherein one of said first and second pair of hollow sections include two flanges extending outwards beyond the hollow sections and in line with a section wall and the other pair of said first and second hollow sections include two flanges extending at right angles to each other; and wherein the gusset plates are secured to said flanges, whereby deformation of the gusset plates is not necessary to join sections therewith.

2. Freight container according to claim 1 wherein said hollow sections are rectangular with the section walls thereof having substantially equal lengths.

3. Freight container according to claim 2 wherein the combined length of the two flanges is greater than the length of the individual section walls.

4. Freight container according to claim 1 wherein said flanges extend on only one side of said hollow sections.

5. Freight container according to claim 1 wherein said flanges of said one pair of said hollow sections are flush with said section wall and extend the section wall outwards.

6. Freight container according to claim 1 wherein one of said flanges of said other pair of hollow sections is in line with a section wall and the second of said flanges is at right angles to a section wall.

7. Freight container according to claim 6 wherein the second of said flanges extends from the center of a section wall.

* * * * *